US005659109A

United States Patent [19]

Fernandez de la Vega et al.

[11] Patent Number: 5,659,109

[45] Date of Patent: Aug. 19, 1997

[54] METHOD FOR REMOVING MERCAPTANS FROM LNG

[75] Inventors: Felix J. Fernandez de la Vega; Charles A. Durr, both of Houston, Tex.

[73] Assignee: The M. W. Kellogg Company, Houston, Tex.

[21] Appl. No.: 657,508

[22] Filed: Jun. 4, 1996

[51] Int. Cl.[6] ..... C07C 7/10; C10G 17/00

[52] U.S. Cl. ..... 585/834; 208/208 R; 208/341; 585/833; 62/922; 62/632; 95/141

[58] Field of Search ..... 585/802, 834, 585/833, 635; 208/340, 341, 342, 208 R; 423/242.1; 62/922, 632; 95/141, 237

[56] References Cited

U.S. PATENT DOCUMENTS 3,407,613 10/1968 Muller et al. ..... 62/11
3,622,504 11/1971 Strum ..... 208/340
4,383,842 5/1983 O'Brien ..... 62/20
4,421,535 12/1983 Mehra ..... 62/17
4,830,733 5/1989 Nagji et al. ..... 208/208 R
4,934,146 6/1990 Wilhelm et al. ..... 62/17

*Primary Examiner*—Glenn A. Caldarola
*Assistant Examiner*—Tanaga Boozer
*Attorney, Agent, or Firm*—The M. W. Kellogg Company

[57] ABSTRACT

A process for liquefying natural gas containing mercaptans. Mercaptans are concentrated into a distillate stream by distilling the feed gas stream without specific pretreatment for mercaptans removal. Thus, the mercaptans removal equipment is much smaller since mercaptans treatment can take place at a point in the process where the flowrate is much lower. A portion of the treated distillate stream can be reinjected to the upstream distilling stage to facilitate mercaptan absorption.

20 Claims, 2 Drawing Sheets

METHOD FOR REMOVING MERCAPTANS FROM LNG

FIELD OF THE INVENTION

This invention relates to a method for liquefying natural gas, and more particularly to the liquefaction of natural gas from a natural gas feed stream containing mercaptans.

BACKGROUND OF THE INVENTION

Raw natural gas for liquefaction is generally relatively clean. Where the raw gas contains contaminants such as water, carbon dioxide and hydrogen sulfide, the gas generally is treated prior to liquefaction to remove these contaminants. As more of the total worldwide gas production is liquefied for ease of handling and transport, the raw natural gas streams more frequently contain excessive mercaptan levels.

Conventionally, the mercaptans have been removed by pretreating the natural gas feed stream with either a physical or chemical solvent, or a molecular sieve. Where high levels of mercaptans are encountered, removal techniques specific to mercaptans must be used in addition to the treatment process for carbon dioxide and hydrogen sulfide.

The use of the physical or chemical solvent systems is expensive and complicated from an operational standpoint. The use of molecular sieves, on the other hand, requires very large beds and bed regeneration can require a volume of regeneration gas as much as 80 percent of the gas feed stream. Also, the off gas produced by regeneration has a very high mercaptan concentration. Such high mercaptan concentrations in the regeneration off gas are typically too severe to be tolerated by a fuel gas system. Also, the regeneration of large molecular sieves results in a substantial fluctuation of the propane, butane and heavier hydrocarbons introduced into a fuel gas system.

Therefore, a need exists for a method for liquefying raw, mercaptan-containing natural gas which avoids the problems and disadvantages associated with the aforementioned prior art natural gas pretreatment methodologies.

SUMMARY OF THE INVENTION

The present invention is based on the discovery that mercaptans can be concentrated into one or more distillate streams obtained by distilling a raw, mercaptan-containing natural gas feed stream. This eliminates any need to specifically pretreat the natural gas feed stream for mercaptan removal. The mercaptan removal equipment necessary in this approach is much smaller since the mercaptans are concentrated in a distillate stream. As a direct consequence, the cost of the mercaptan removal equipment is substantially reduced in comparison to the cost of equipment in the prior art pretreatment methods, and also the cost of operating the equipment is substantially reduced.

The present invention provides a method for separating mercaptans from a natural gas feed stream to be liquefied. The method comprises the steps of: (a) introducing the feed stream to a refluxed scrub column to form an overhead methane stream and a liquid bottom stream rich in ethane and heavier hydrocarbons; (b) fractionating the bottom stream from step (a) to form a natural gas liquid stream comprising pentane and heavier hydrocarbons and one or more overhead streams comprising primarily ethane, propane and butane; (c) removing mercaptans from at least one of the overhead streams from step (b) to form a mercaptan-lean stream; (d) partially condensing and separating the overhead stream from step (a) to form vapor and liquid streams; (e) recycling at least a portion of the liquid stream from step (d) as at least a portion of the reflux to the scrub column in step (a); and (f) cooling the vapor stream from step (d) to form a liquefied natural gas stream. If desired, the feed stream can be conventionally pretreated to remove acid gases and water prior to the introduction step (a). The pretreatment step can include hydrogen sulfide removal, for example. The method preferably further comprises adding at least a portion of the mercaptan-lean stream from step (c) to the overhead methane stream from step (a) for partial condensation and separation therewith in step (d). The method is applicable to treating feed streams having a mercaptan concentration of at least about 4 ppm, but is particularly advantageous when the feed stream contains at least about 50 ppm. The vapor stream from step (d) preferably comprises a mercaptan concentration less than about 20 percent by weight of the original mercaptan concentration in the natural gas feed stream, more preferably less than 10 ppm by weight of the vapor stream from step (d).

The fractionation step (b), involving a series of distillation stages, can comprise a deethanizer-first configuration, i.e. feeding the bottom stream from step (a) to a deethanizer wherein the bottom stream is distilled to form an ethane overhead stream in a bottom stream essentially free of ethane. The bottom stream from the deethanizer is then fed to a depropanizer wherein it is distilled to form a propane overhead stream and a bottom stream essentially free of propane. Similarly, the bottom stream from the depropanizer is fed to a debutanizer wherein it is distilled to form a butane overhead stream and a bottom natural gas liquid stream essentially free of butane.

The propane and butane overhead streams are preferably combined for mercaptan removal in step (c) to form a mercaptan lean stream comprising primarily propane and butane. The ethane overhead stream from step (b) is preferably combined with a vapor stream from step (d) for cooling in a step (f) to form a liquefied natural gas stream. If desired, the method can also include the step (g) of rejecting nitrogen from the liquefied natural gas stream to form an LNG product stream.

The scrub column can be operated at a relatively high reflux/feed ratio and with more equilibrium stages relative to a conventional scrub column. A reflux/feed weight ratio of at least 0.5 is preferred, more preferably a reflux/feed weight ratio of at least 1.0. Generally, 5 equilibrium stages are sufficient, but 8 or more stages can be preferred for reducing the mercaptan content of the overhead stream from the scrub column.

The mercaptan removal step can be effected using a molecular sieve unit. Preferably, the molecular sieve unit includes three beds arranged for alternating two beds in mercaptan removal service with simultaneous regeneration of the third bed. Alternatively, the mercaptan removal step can be effected using a caustic wash.

DETAILED DESCRIPTION OF THE INVENTION

A natural gas liquefaction feed stream is fractionated by distillation, without specific initial pretreatment for mercaptans removal, to concentrate mercaptan contaminants into a distillate stream. The mercaptans-rich distillate stream, thus formed, is treated for mercaptans removal and a portion thereof is preferably recycled as a mercaptans absorbent to the distillation stage. By avoiding specifically pretreating the liquefaction feed stream for mercaptans and locating mercaptans treatment downstream, the size of the mercaptans removal equipment and operational costs can be greatly reduced. Also where a molecular sieve bed is used, a smaller volume of regeneration off gas is produced, thus avoiding taxing the fuel gas system receiving the off gas.

Figure 1:
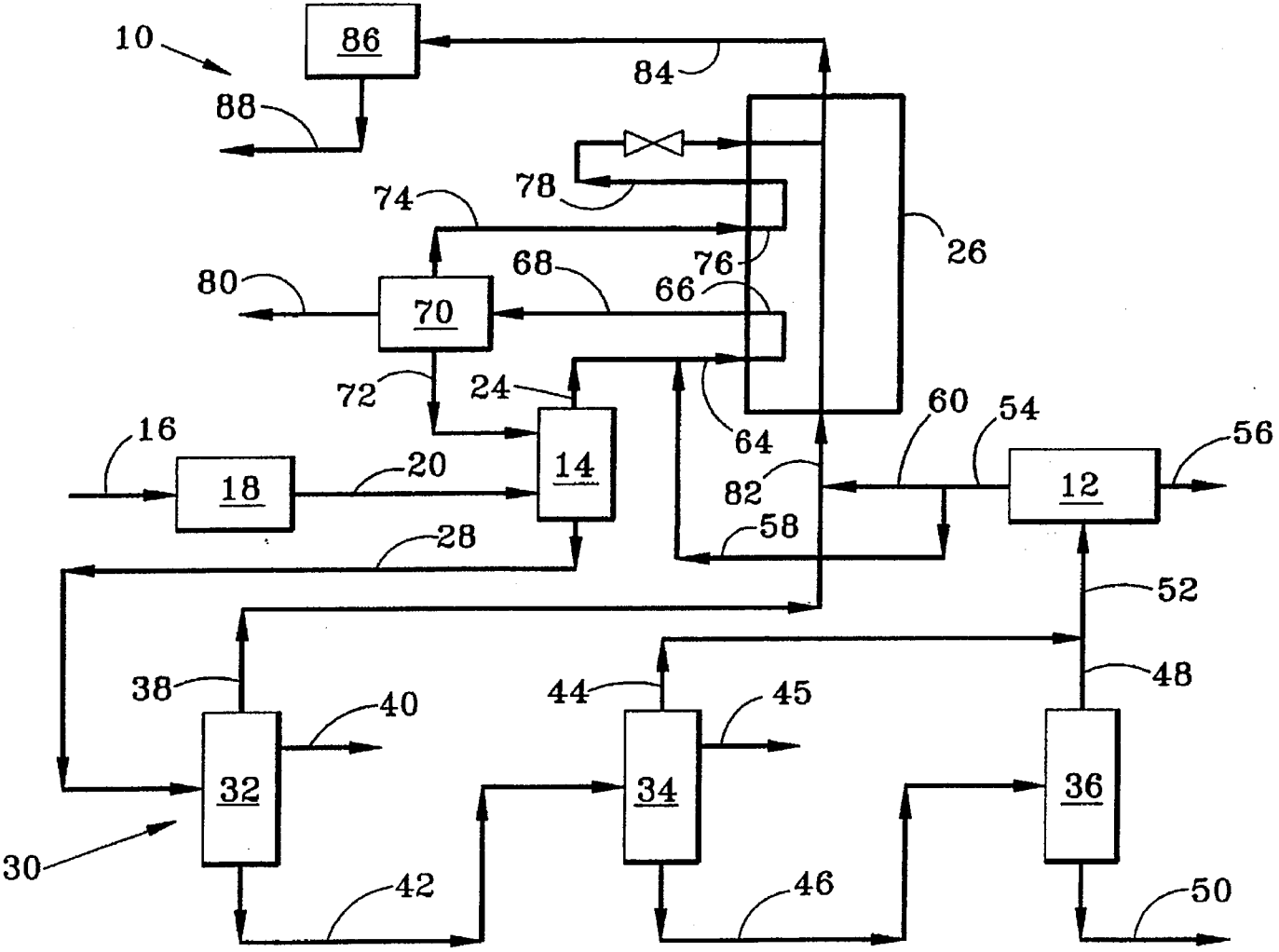
FIG. 1 is a schematic process flow diagram of the natural gas liquefaction method according to one embodiment of the invention showing depropanizer and debutanizer overhead streams treated for mercaptan removal and a portion thereof recycled to the scrub column.
Figure 2:
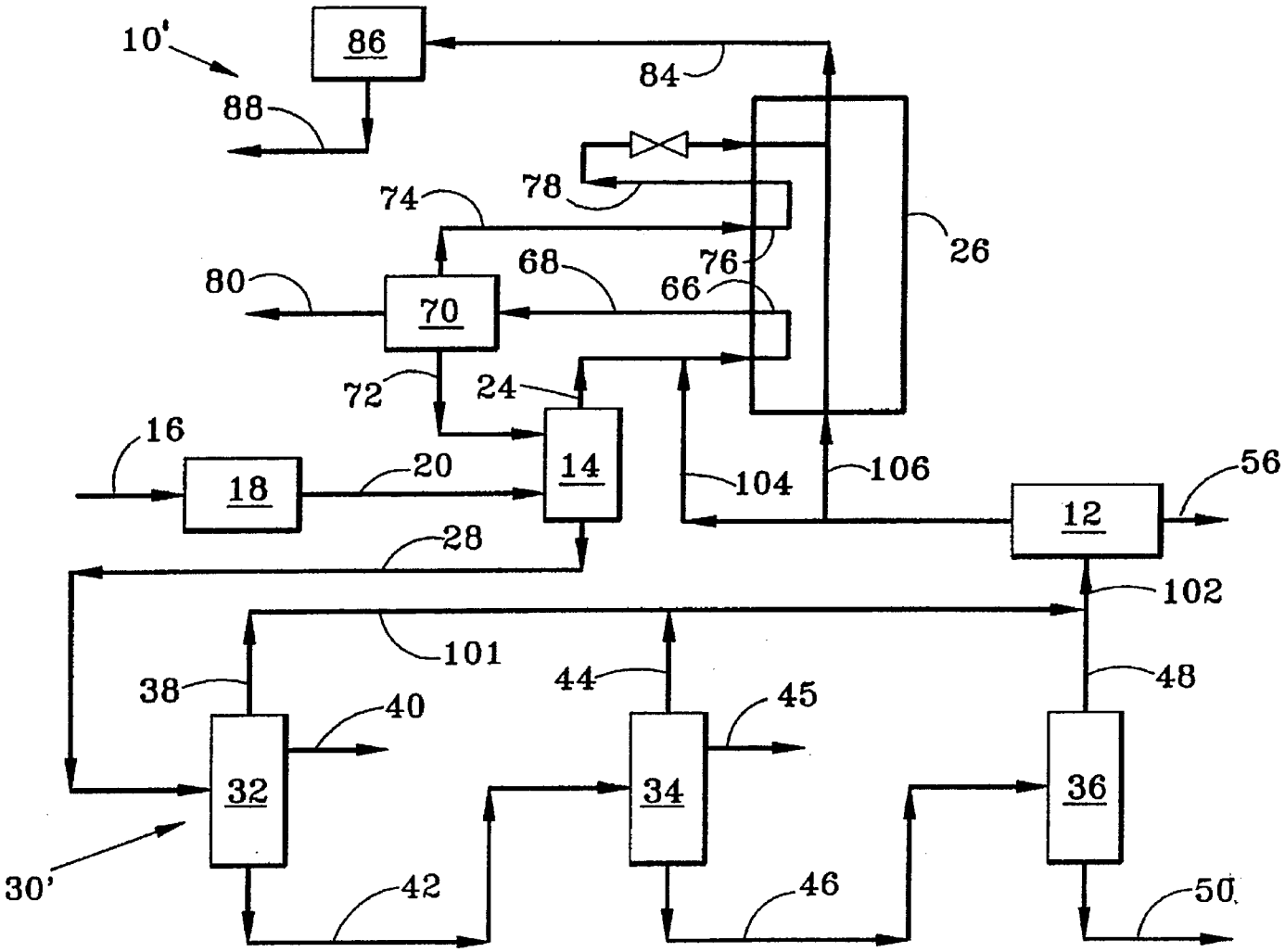
FIG. 2 is a schematic process flow diagram of the natural gas liquefaction method according to another embodiment of the invention showing each of the fractionation stage overhead streams treated for mercaptan removal and a portion thereof recycled to the scrub column.

Referring to FIGS. 1–2, wherein like numerals reference similar parts, a natural gas liquefaction process 10, 10' of the present invention employs a mercaptan removal stage 12 downstream of a scrub column 14. A raw natural gas stream comprises an elevated concentration of mercaptans as well as other well known contaminants such as water, $CO_2$, mercury, hydrogen sulfide, and the like. The raw gas stream is directed through line 16 to a pretreatment stage 18 for removal of the non-mercaptan contaminants. Any method for separating contaminants from a gaseous bulk phase can be used. Among well known methods are adsorption such as by molecular sieve, ion exchange, and the like; and absorption using a suitable liquid chemical or physical solvent.

Following the pretreatment stage 18, a treated, mercaptan-containing stream is introduced through line 20 to a scrub column 14. The feed stream 20 to the scrub column 14 generally has a mercaptan concentration of at least about 4 ppm by mole, but preferably at least about 50 ppm by mole. In the scrub column 14, $C_2$ and higher molecular weight hydrocarbons are substantially separated from methane and lighter components (e.g. nitrogen). In addition, the mercaptan level in the feed stream 20 is reduced to an acceptable concentration for a liquefied natural gas (LNG) product. A mercaptans-lean overhead stream comprising primarily methane is removed from the column 14 via line 24 for liquefaction in a cryogenic cooling stage 26. A mercaptans-rich bottoms stream comprising much of the $C_2$ and heavier components is removed from the column 14 via line 28 and directed to a fractionation stage 30 to recover ethane and propane for refrigeration make-up and natural gas liquids (NGL).

Operation and design of the scrub column 14 are well known in the art. Criteria guiding scrub column design include the desired heat content and level of mercaptans of the LNG product, and the extent of removal of freezable components contained in the original natural gas liquefaction feed stream. The scrub column will typically have from 5 to 8 or more trays, and a reflux to feed weight ratio of at least about 0.5, and preferably at least 1.0.

It has been discovered that as much as 80 mole percent or more of the mercaptans in the feed stream 20 exit the scrub column 14 in the bottoms stream 28, without additional reflux, and are concentrated in depropanizer and debutanizer overhead streams of the fractionation stage 30 so that mercaptans removal is most advantageously effected at a point in the process where the flowrate, i.e. the quantity of material being treated, is greatly reduced.

The fractionation stage 30 preferably comprises a deethanizer column 32, a depropanizer column 34 and a debutanizer column 36 operated in a conventional fashion to recover ethane, propane, butane and NGL products, respectively. The deethanizer 32 substantially separates ethane and lighter components from propane and heavier components including the mercaptans. A mercaptans-lean overhead vapor stream comprising primarily ethane and a minor amount of methane is removed from the deethanizer 32 via line 38 for addition to the LNG product. An ethane-containing side stream can be removed from the deethanizer 32 through line 40 as make-up for use in an ethane-based refrigerant.

A mercaptans-rich bottoms stream comprising propane and heavier components is directed from the deethanizer 32 to the depropanizer 34 via line 42. The depropanizer 34 substantially separates propane from the butanes and heavier hydrocarbon components. Mercaptans originally present in the feed stream 20 and now contained in the depropanizer feed stream 42 are split between the overhead and bottoms streams with a major portion of the mercaptans concentrated in the bottoms stream. A liquid overhead stream comprising propane and a major portion of the mercaptans is removed from the depropanizer 34 via line 44 and directed to the mercaptan removal unit 12. A side stream can be removed through line 45 as propane refrigerant make-up.

The bottoms stream from the depropanizer 34 comprising primarily butanes and heavier hydrocarbons and the major portion of the mercaptans originally present in the feed stream 20 is directed to the debutanizer 36 via line 46. The debutanizer 36 substantially separates butaries as a liquid overheads stream from the pentanes and heavier hydrocarbons as a bottoms stream comprising the NGL product. In addition, the mercaptans present in the debutanizer feed stream 46 are split between the overhead and bottoms streams so that a major portion of the mercaptans present in the feed stream 46 is concentrated in the overhead stream with a minor portion remaining in the bottoms stream. The liquid overhead stream comprising butanes and the major portion of the mercaptans present in the feed stream 46 is removed from the debutanizer 36 via line 48 and directed to the mercaptan removal unit 12. The NGL product containing a minor portion of the mercaptans present in the debutanizer feed is withdrawn from the debutanizer 36 via line 50.

The mercaptans-containing overhead streams 44, 48 removed from the depropanizer 34 and debutanizer 36 are preferably combined and introduced to the mercaptan removal unit 12 via line 52. The mercaptan removal unit 12 can comprise any suitable purification means known in the art including molecular sieve adsorption, carbon adsorption, caustic absorption, physical solvent absorption, chemical solvent absorption, and the like, depending on the physical state of the feed stream 52. When a molecular sieve is used, a three bed configuration (not shown) is preferred with two beds on-line in parallel or series, and one bed in regeneration mode. An essentially mercaptans-free stream comprising primarily liquid propane and butane (i.e. liquefied propane gas (LPG)) is withdrawn from the mercaptan removal unit 12 via line 54. Regeneration of the molecular sieve beds forms a mercaptans-rich stream withdrawn through line 56 for disposal in a fuel gas system (not shown).

A first portion of the mercaptans-lean LPG stream 54 is reinjected into the scrub column 14 as a lean oil reflux via line 58. A second portion of the LPG stream 54 is directed to the cooling stage 26 via line 60 for addition to a mercaptan-lean liquid stream described below to form the LNG product. The reinjection stream 58 is preferably cooled by a reinjection cooler (not shown) and combined with the methane-rich overhead stream 24 from the scrub column 14. A combined reinjection stream is then passed via line 64 to a warm condenser bundle 66 disposed in the cryogenic cooling stage 26. The condenser bundle 66 is operated at a temperature to condense a portion of the combined stream 64. A stream removed from the warm condenser bundle 66 is then directed via line 68 to a vapor-liquid separation drum 70 to separate a reflux stream from methane-containing vapor. The reflux stream is introduced to the scrub column 14 via line 72 as an absorbent to facilitate mercaptan distribution into bottoms stream 28.

A mercaptan-lean vapor stream comprising primarily methane is removed from the drum 70 and directed via line 74 to a cold condenser bundle 76 disposed in the cryogenic cooling stage 26. The bundle 76 operates at a temperature using a refrigerant suitable for condensing the methane-rich stream 74. A mercaptan-lean, liquid methane stream comprising a bulk of the LNG product is removed from the bundle 76 via line 78. A methane vapor side stream is preferably removed from the drum 70 via line 80 as refrigerant make-up in the methane refrigeration system (not shown).

The remaining portion of the LPG stream 54 not reinjected in the scrub column 14 is preferably combined via line 60 with the overhead stream 38 of the deethanizer 32, introduced to the cooling stage 26 via line 82 and combined with the liquid methane stream 78 to form a mercaptans-lean LNG stream in line 84. The stream 84 generally comprises a mercaptan concentration less than about 20 percent by weight of the mercaptan concentration in the feed stream 20. As a result, the stream 84 has a mercaptans concentration of 50 ppm by mole or less, but preferably a mercaptans concentration of 10 ppm by mole or less.

Nitrogen preferably is removed from the LNG stream 84 in a nitrogen rejection unit 86, typically by fractionation or another conventional nitrogen removal procedure. A finished LNG product stream having a mercaptan concentration no greater than the required specification is removed from the nitrogen rejection unit 86 via line 88.

In an alternative embodiment 10' having a fractionation stage 30' as seen in FIG. 2, the deethanizer column 32 is preferably operated at total reflux. An overhead stream 101 having a liquid state is withdrawn from the deethanizer 32 and combined with the liquid mercaptans-containing overhead streams 44, 48 from the depropanizer and debutanizer 34, 36 to form a liquid $C_{1-4}$ aggregate stream in line 102. Mercaptans are removed from the aggregate stream 102 in the mercaptan removal unit 12 to produce a mercaptans-lean aggregate stream.

A first portion of this mercaptans-lean aggregate stream is reinjected into the scrub column via line 104 as the lean oil reflux, while a second or remaining portion is introduced into the liquid methane stream 78 via line 106 to form a low mercaptans LNG product.

EXAMPLE

The natural gas liquefaction process of the present invention is analyzed by computer simulation to determine mercaptans material balance, optimize design criteria, and evaluate tradeoffs. Basis for the calculations are a natural gas feed flowrate of 22,100 kmol/hr to the scrub column 14. The natural gas feed has a composition of about 80 mole percent methane, 7 mole percent ethane, 2 mole percent propane, 2 mole percent butanes, 1 mole percent $C_{5+}$, 8 mole percent nitrogen and 320 ppm mercaptans. The scrub column 14 operating criteria are 0.94 $C_1/C_2$ ratio and −51° C. overhead temperature. Mercaptans composition in the material balance is 20 percent methylmercaptan, 60 percent ethylmercaptan, 16 percent propylmercaptan, 3 percent butylmercaptan and 1 percent carbonyl sulfide.

A simplifying assumption made in the material balance is that all the $C_{1-2}$ in the scrub column bottoms exits the deethanizer overhead, the depropanizer overhead contains all the $C_3$, and the debutanizer overhead contains all the $C_4$'s. Refrigeration power estimates are based on known power versus temperature curves which predict an increase of 1 kW in refrigeration power for each additional kW of the warm bundle 66 refrigeration duty, and an increase of 0.5 kW in refrigeration power for each additional kW of propane refrigeration duty of the reinjection cooler (not shown). Any effects on pumping power and cooling water duty are neglected.

Operation of the scrub column 14 is optimized with regard to parameters including recycle injection point, number of stages, and recycle configuration, e.g. recycle of all the $C_{1-4}$ overheads of the fractionation stage 30' or a recycle limited to the $C_{3-4}$ overheads of the depropanizer 34 and debutanizer 36. Other parameters investigated are recycle composition and flowrate.

Simulation results indicate that the required reinjection point is in the overhead of the scrub column 14. Three additional stages are also added below the feed point, and simulations are conducted for both 5 and 8 stages. The additional stages reduce the required additional refrigeration power by about 10 percent.

Recycling the $C_{1-4}$ overheads does not make a significant difference in terms of the required increase in the diameter of the fractionation stage columns and the refrigeration power compared to recycling only the $C_{3-4}$ overheads. Limiting recycle to the $C_{3-4}$ overheads reduces the size of the mercaptan removal unit 12 and eliminates the need for condensing the deethanizer overhead vapor 38 upstream of the mercaptan removal stage 12.

The ratio of $C_3$ to $C_4$ in the recycle stream 58 is optimized. Starting with the normal ratio present in the aggregate $C_{3-4}$ overheads, increasing the proportion of $C_3$ results in higher recoveries but also increases the amount of propane lost in the scrub column overhead stream 24. However, by maintaining the $C_3/C_4$ ratio at the normal value but increasing the recycle rate (but not exceeding the limit) the LNG specifications are met and sufficient propane for refrigerant make-up is generated. Given a normal $C_3/C_4$ ratio of 0.82 (as indicated by the material balance), a recycle rate of 534 kmol/hr is required to meet the LNG specification of a mercaptan concentration of 8 ppm (by mole) with propane losses in the scrub column overhead stream 24 still under control. The relationship of mercaptan concentration to recycle rate indicates that increasing the recycle rate gives a relatively minor enhancement of results.

A comparison of the simulation results is given in the Table. The $C_{3-4}$ depropanizer/debutanizer overheads recycle configuration as shown in FIG. 1 only requires treating a 755 kmol/hr LPG liquids stream for mercaptans and recycling 70 percent of the treated liquids to the scrub column 12 and the fractionation stage 30. In comparison to the prior art having front end mercaptan removal, both the volume of the molecular sieve adsorbers and the regeneration gas flowrate can be decreased by as much as 80 percent and a prior art liquid extraction unit can be eliminated. As a tradeoff with 534 kmol/hr of LPG liquids recycled to the scrub column overhead, the column diameters in the fractionation stage 30 are increased by 60–80% and the refrigeration power for liquefaction is increased by about 3.7 MW of which 1.7 MW is for the warm condenser bundle 66, 0.9 MW is for the LPG reinjection cooler (not shown) and 1.1 MW is for the deethanizer overhead condenser (not shown). The increase in refrigeration power implies a decrease in LNG capacity of roughly 3% but is paid for by the savings in capital and operating costs.

TABLE

| Design/Calculated Item | Case | | |
|---|---|---|---|
| | $C_{3-4}$ Recycle 58 | $C_{3-4}$ Recycle 58 | $C_{1-4}$ Recycle 104 |
| Scrub column 14: | | | |
| No. of stages | 5 | 8 | 5 |
| Mercaptan conc. (ppm) | 8 | 8 | 8 |
| Recycle flow (kmol/hr) | 534 | 534 | 771 |
| Total reinjection flow 110 (kmol/hr) | 627 | 717 | 380 |
| Overhead flow 24 (kmol/hr) | 24351 | 24029 | 24400 |
| Bottoms flow 28 (kmol/hr) | 1315 | 1403 | 1317 |
| Warm bundle 66 duty (kW) | 11153 | 10323 | 10916 |
| Reinjection cooler (not shown) duty | 2931 | 3204 | 2931 |
| Increase in col. dia. | 3% | 3% | 3% |
| Deethanizer 32: | | | |
| Overhead flow 38 (kmol/hr) | 418 | 508 | 425 |
| Bottoms flow 42 (kmol/hr) | 897 | 895 | 892 |
| Condenser duty (not shown) (kmol/hr) | 3310 | 4022 | 3370 |
| Increase in col. dia. | 70% | 87% | 70% |
| Depropanizer 34: | | | |
| Overhead flow 44 (kmol/hr) | 358 | 361 | 341 |
| Bottoms flow 46 (kmol/hr) | 539 | 534 | 551 |
| Increase in col. dia. | 78% | 78% | 74% |
| Debutanizer 36: | | | |
| Overhead flow 48 (kmol/hr) | 416 | 413 | 416 |
| Bottoms flow 50 (kmol/hr) | 123 | 121 | 135 |
| Increase in col. dia. | 60% | 60% | 60% |
| Additional refrigeration Power (kW) | 3666 | 3322 | 3465 |
| Mercaptan recovery unit 12: | | | |
| Flowrate (kmol/hr) | 755 | 755 | 1156 |
| Mercaptan conc. inlet 52 (ppm) | 6823 | 6823 | 6823 |
| Mercaptan conc. outlet 54 (ppm) | 1 | 1 | 1 |

The present natural gas liquefaction process is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

We claim:

1. A method for separating mercaptans from a natural gas feed stream to be liquefied, comprising the steps of:

(a) introducing the feed stream to a refluxed scrub column to form an overhead methane stream and a liquid bottoms stream rich in ethane and heavier hydrocarbons;

(b) fractionating the bottoms stream from step (a) to form a natural gas liquids stream comprising pentane and heavier hydrocarbons, and one or more overhead streams comprising primarily ethane, propane and butane;

(c) removing mercaptans from at least one of the overhead streams from step (b) to form a mercaptan-lean stream;

(d) partially condensing and separating the overhead stream from step (a) to form vapor and liquid streams;

(e) recycling at least a portion of the liquid stream from step (d) as at least a portion of the reflux to the scrub column in step (a);

(f) cooling the vapor stream from step (d) to form a liquefied natural gas stream.

2. The method of claim 1, comprising the step of pretreating the feed stream to remove acid gases and water prior to the introduction step (a).

3. The method of claim 2, wherein the pretreatment step includes hydrogen sulfide removal.

4. The method of claim 1, wherein the feed stream has a mercaptan concentration of at least about 4 ppm and the vapor stream from step (e) comprises less than about 20 percent by weight of the mercaptan in the feed stream.

5. The method of claim 1, wherein the feed stream has a mercaptan concentration of at least about 50 ppm.

6. The method of claim 1, wherein the vapor stream from step (d) has a mercaptan concentration less than about 100 ppm.

7. The method of claim 1, wherein the vapor stream from step (d) has a mercaptan concentration less than about 10 ppm.

8. The method of claim 1, further comprising the step of adding at least a portion of the mercaptan-lean stream from step (c) to the overhead methane stream from step (a) for partial condensation and separation therewith in step (d).

9. The method of claim 8, wherein the fractionation step (b) comprises:

(1) feeding the bottoms stream from step (a) to a deethanizer to form an ethane overhead stream and a bottoms stream essentially free of ethane;

(2) feeding the bottoms stream from step (1) to a depropanizer to form a propane overhead stream and a bottoms stream essentially free of propane;

(3) feeding the bottoms stream from step (2) to a debutanizer to form a butane overhead stream and the natural gas liquids stream.

10. The method of claim 8, wherein propane and butane overhead streams from step (b) are combined for mercaptan removal in step (c) to form a mercaptan-lean stream comprising primarily propane and butane essentially free of ethane.

11. The method of claim 8, wherein an ethane overhead stream from step (b) is combined with the vapor stream from step (d) for cooling in step (f) to form the liquefied natural gas stream.

12. The method of claim 1, comprising the step of rejecting nitrogen from the liquefied natural gas stream from step (f) to form an LNG product stream.

13. The method of claim 1, wherein the scrub column is operated with a feed/reflux weight ratio of at least 0.5 and has at least 5 equilibrium stages.

14. The method of claim 1, wherein the scrub column is operated with a feed/reflux weight ratio of at least 1.0 and has at least 8 equilibrium stages.

15. The method of claim 1, wherein the mercaptan removal step (c) comprises passing the overhead stream or streams through a molecular sieve unit.

16. The method of claim 15, wherein the molecular sieve unit includes three beds arranged for alternating mercaptan removal service by two beds with simultaneous regeneration of the other bed.

17. The method of claim 1, wherein the mercaptan removal step (c) comprises passing the overhead stream or streams through a carbon absorption unit.

18. The method of claim 1, wherein the mercaptan removal step (c) comprises passing the overhead stream or streams in contact with caustic.

19. The method of claim 1, wherein the mercaptan removal step (c) comprises passing the overhead stream or streams in contact with a physical solvent.

20. The method of claim 1, wherein the mercaptan removal step (c) comprises passing the overhead stream or streams in contact with a chemical solvent.

* * * * *